United States Patent [19]

Claassens

[11] 4,266,341

[45] May 12, 1981

[54] HAIR TRIMMING APPARATUS

[75] Inventor: Antonius P. J. A. Claassens, Drachten, Netherlands

[73] Assignee: U.S. Philips Corporation, New York, N.Y.

[21] Appl. No.: 24,126

[22] Filed: Mar. 26, 1979

[30] Foreign Application Priority Data

Jun. 30, 1978 [NL] Netherlands ..... 7807173

[51] Int. Cl.[3] ..... B26B 19/00

[52] U.S. Cl. ..... 30/195; 30/210

[58] Field of Search ..... 30/195, 210

[56] References Cited

U.S. PATENT DOCUMENTS

| | | | |
|---|---|---|---|
| 2,001,206 | 5/1935 | Matthes | 30/195 |
| 2,008,631 | 7/1935 | Udkovich | 30/195 |
| 2,035,632 | 3/1936 | Andis | 30/195 |
| 2,693,640 | 11/1954 | Scheiwer | 30/195 |

*Primary Examiner*—Jimmy C. Peters

*Attorney, Agent, or Firm*—Thomas A. Briody; William J. Streeter; Rolf E. Schneider

[57] ABSTRACT

There is provided a hair trimming device comprising a stationary cutting element and a cooperating second cutting element. Each cutting element has a longitudinally extending side provided with spaced teeth extending in a direction substantially transverse to such side, the second cutting element being drivable relative to the stationary cutting element in such transverse direction. Each tooth of the drivable cutting element cooperates with a corresponding tooth of the stationary cutting element to form a pair, with the teeth in each pair partially overlapping each other. A recess is formed in at least one side edge of each tooth of one such cutting element, with at least part of the recess edge constituting a cutting edge. Each tooth of the other such cutting element has a cutting edge, the cutting edges on the teeth of each pair cooperating with each other.

6 Claims, 18 Drawing Figures

HAIR TRIMMING APPARATUS

This invention relates to a hair trimming apparatus or device provided with a stationary cutting element, and a cutting element which is drivable relative thereto, each cutting element having a side with teeth which extend substantially transversely to the longitudinal direction of said side, which teeth are provided with cutting edges.

Such a hair trimming apparatus is for example known from U.S. Pat. No. 3,962,785. It has been found that practically all the hairs which come within reach of the teeth of the known apparatus are cut immediately.

The object of the present invention is to provide a hair trimming apparatus whose teeth can penetrate the hair without all the hairs which are situated between the teeth being cut. In particular, a hair trimming apparatus is aimed at, which permits hairs underneath the hairs at the surface to be cut, whilst hairs at the surface are left undisturbed, so that the apparatus is suitable for so-called thinning.

For this purpose the hair trimming apparatus in accordance with the invention is characterized in that two cooperating teeth, which constitute a pair of teeth, at least partly overlap each other in every position, a clearance being left between two adjacent pairs of teeth, and that in at least one side edge of each tooth of one of the cutting elements a recess is formed, at least a part of the edge of the recess constituting the cutting edge.

This construction ensures that during the cutting movement the apparatus also has a certain combing action, so that the teeth can readily penetrate the hair, and that only those hairs which are situated in the recesses of the teeth are cut.

A preferred embodiment of the hair trimming apparatus in accordance with the invention is characterized in that the drivable cutting element is drivable in the tooth direction. As a result of this, the clearance between two adjoining pairs of teeth remains fairly large.

Preferably, the drivable cutting element is drivable only in the tooth direction and two cooperating teeth substantially coincide. The size of the gap between two adjacent pairs of teeth is then a maximum, which is very favourable in respect of the combing action.

A preferred embodiment of the hair trimming apparatus in accordance with the invention is characterized in that the recesses are formed in the teeth of the stationary cutting element.

A further preferred embodiment of the hair cutting apparatus in accordance with the invention is characterized in that the cutting edge of each tooth of the stationary cutting element extends transversely to the tooth direction, and that the cutting edge of each tooth of the drivable cutting element is situated at the end of the tooth and also extends transversely to the tooth direction.

Yet a further preferred embodiment of the hair trimming apparatus in accordance with the invention is characterized in that the distance between the cutting edges of two cooperating pairs of teeth differs from that between the cutting edges of two other cooperating pairs of teeth, at least measured in the tooth direction and between corresponding points of the cutting edges. Thus it is prevented that several hairs are cut at a time, so that the motor need not handle a high peak load.

The invention will now be described in more detail with reference to the accompanying drawings, in which.

FIGS. 5*a* to *h* show other examples of pairs of teeth.

FIGS. 6*a* to *d* schematically show the cutting elements of a hair trimming apparatus, the drivable cutting element performing a rotary movement.

Figure 7:
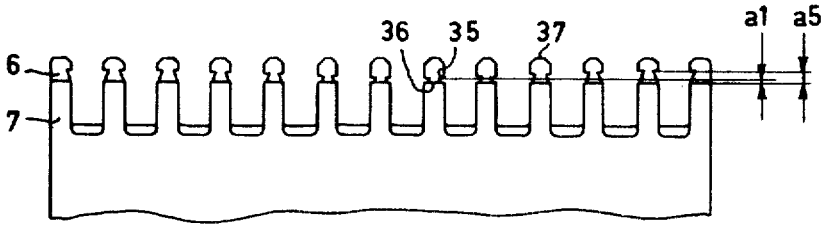

FIG. 7 shows a hair trimming apparatus, the distance between the cutting edges of certain pairs of teeth being different from the distance between the cutting edges of other pairs of teeth.

Figure 1:
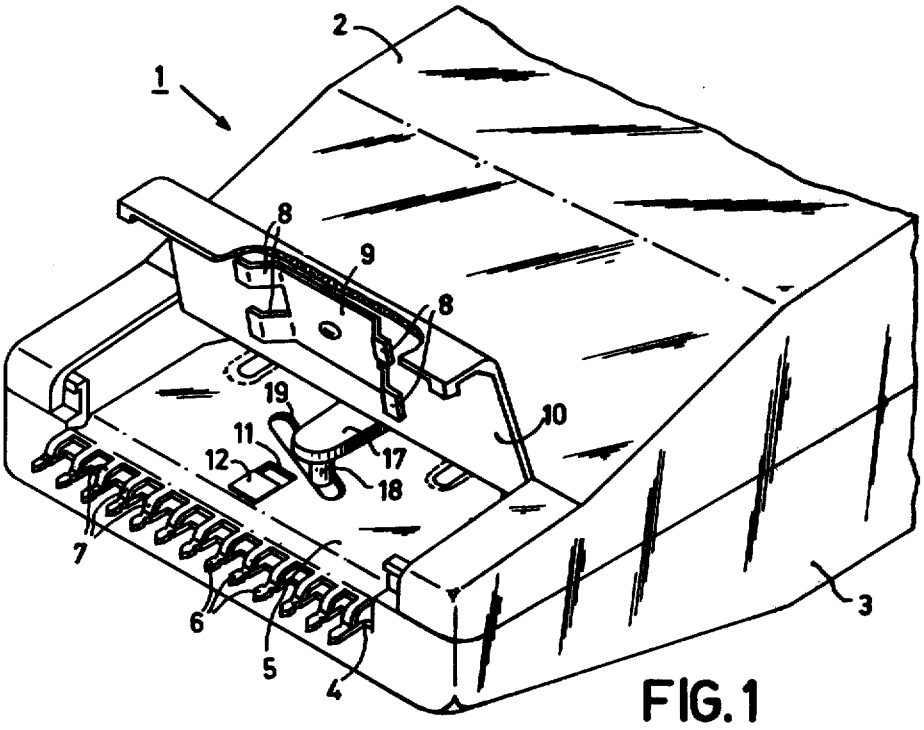
FIG. 1 is a perspective view of the front part of a hair trimming apparatus with the cap opened.
Figure 2:
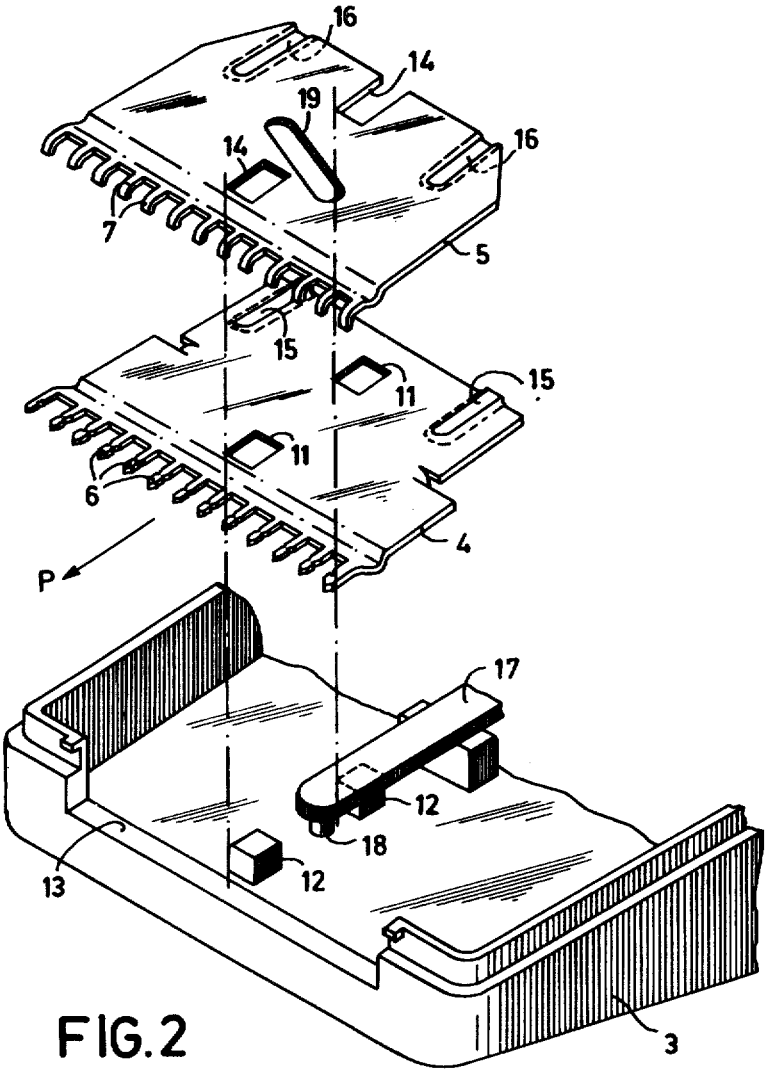
FIG. 2 shows an exploded view of the hair trimming apparatus of FIG. 1.
Figure 8:
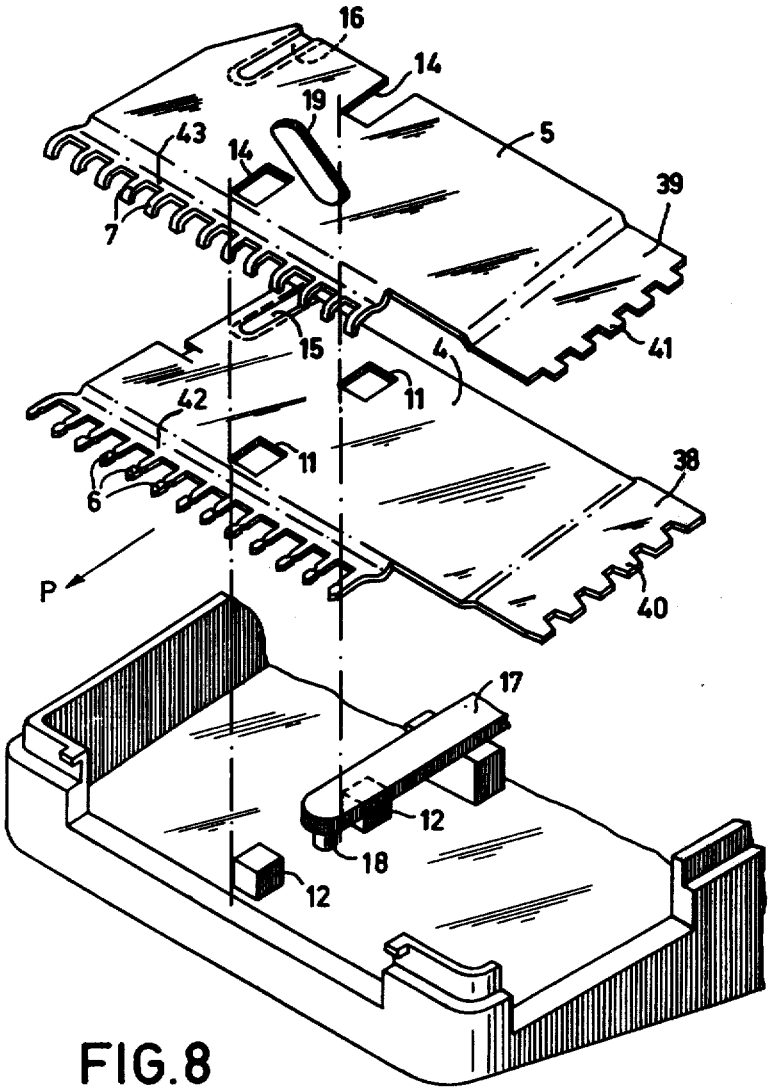

FIG. 8 in a similar way as FIG. 2 shows a variant of the hair trimming apparatus of FIGS. 1 and 2.

The hair trimming apparatus as shown in FIG. 1 comprises a housing 1 which consists of two halves 2 and 3. The housing accommodates an electric drive motor, not shown. The housing includes a stationary cutting element 4 and a cutting element 5 which cooperates therewith and is drivable by the motor. The cutting elements are each provided with a row of teeth 6 and 7 respectively and are together disposed near an end of the housing in such a way that the rows of teeth project from the housing. The resilient means for resiliently urging the cutting elements 4 and 5 against each other is constituted by four leaf springs 8 which form part of a single component 9. The part of each cutting element 4, 5 situated inside the housing 1, is covered by a cap 10 which is hingedly connected to the housing section 2.

As is shown in FIG. 2, the stationary cutting element 4 is centered on cams 12 of the housing section 3 by recesses 11. At the front this cutting element is situated on a rim 13 of the housing section 3. The drivable cutting element 5 is journalled so as to be movable relative to the stationary cutting element 4 in the tooth direction P with the aid of recesses 14 and cams 12. For this purpose the dimensions of the recesses 14 in the tooth direction P are slightly greater than those of the Cam 12. Furthermore, the two cutting elements are provided with supporting surfaces 15 and 16. The cutting elements slide over each other via the teeth 6, 7 and the supporting surface 15, 16. The drivable cutting element 5 can be driven so as to reciprocate in the tooth direction P via a drive lever 17, which is provided with a pin 18. The drive lever itself is reciprocated by the motor in a direction transverse to the tooth direction P. As the movement of the cutting element 5 is perpendicular to the movement of the drive lever 17, the cutting element 5 is provided with a slot 19, which extends obliquely relative to the tooth direction P. The pin 18 of the drive engages with the slot 19.

Figure 3:
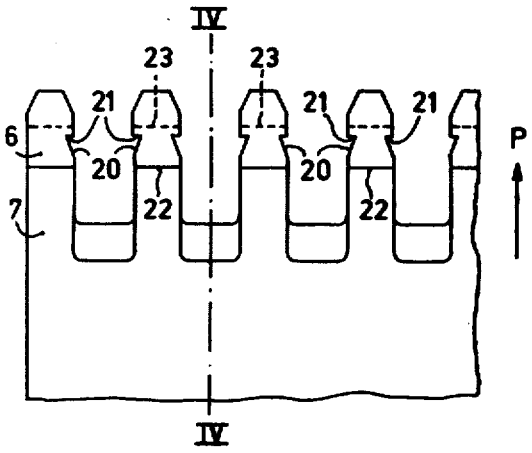
FIG. 3 shows some pairs of teeth of the hair trimming apparatus of FIG. 1 on an enlarged scale.
Figure 4:
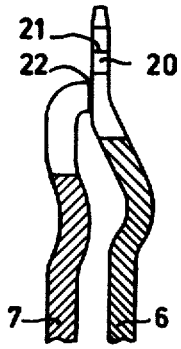
FIG. 4 is a cross-section taken on the line IV—IV of FIG. 3.

FIGS. 3 and 4 show the teeth 6 and 7 respectively on an enlarged scale. In the side edges of the teeth 6 of the stationary cutting element 4 triangular recesses 20 are formed. The portion 21 of each edge of the recess 20 is perpendicular to the tooth direction P and constitutes the cutting edge of the tooth. The cutting edges of the teeth 7 of the drivable cutting element 5 are situated at the ends 22 of the teeth and are also transverse to the tooth direction P. In the present example two cooperating teeth 6 and 7, which constitute a pair of teeth, coincide. During the movement of the drivable cutting element 5 the distance between two adjacent pairs of teeth remains constant, so that the clearance between the two pairs of teeth is sufficiently large to ensure a satisfactory combing action, which is necessary to penetrate the hair with the toothed cutting elements. Thinning is achieved in that during the reciprocating movement of the drivable cutting element between the positions designated 22 and 23 only those hairs are cut which are situated in the recesses 20. In general this will only be a fraction of the total number of the hairs situated between the pairs of teeth.

Figure 5A:
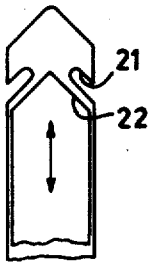
Figure 5B:
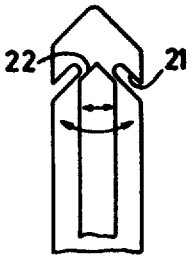
Figure 5C:
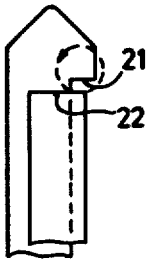
Figure 5D:
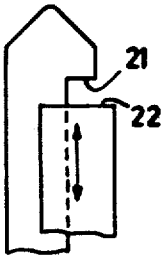
Figure 5E:
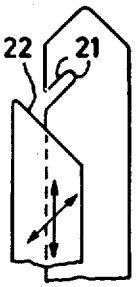
Figure 5F:
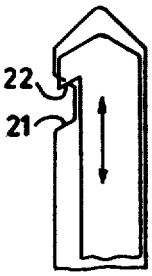
Figure 5G:
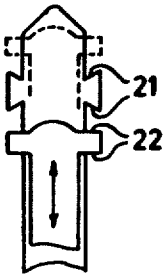
Figure 5H:
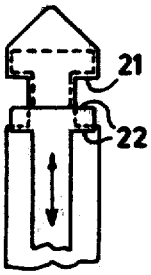

Obviously, other forms of recesses as well as other directions of movement of the drivable cutting element are possible. As an example it is not absolutely necessary that the drivable cutting element coincides with the stationary cutting element in every position. For a thinning apparatus it is important that in every position of the cutting elements relative to each other sufficient clearance is left between two adjacent pairs of teeth so as to allow the hairs to penetrate, i.e. there should continually be a combing action. FIGS. 5*a, b, c, d, e, f, g* and *h* show a number of possible constructions of pairs of teeth, an arrow indicating the respective direction of movement of the drivable cutting element. The cutting edges bear the same reference numerals as in FIG. 3.

Figure 6B:
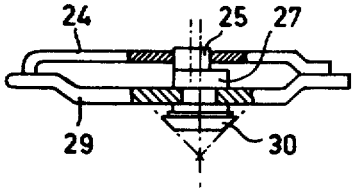
Figure 6D:
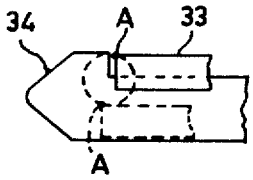
Figure 6A:
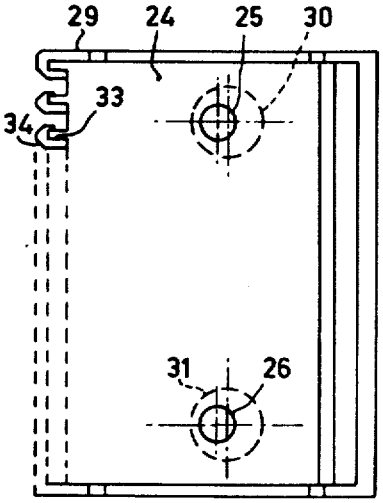
Figure 6C:
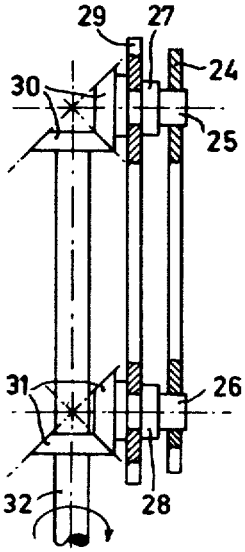

FIGS. 6*a, b,* and *c* schematically show a construction in which the drivable cutting element performs a rotary movement. The cutting element 24 is driven with the aid of two synchronously running eccentric spindles 25 and 26 which form part of the stubs 27 and 28. These spindles, which pass through openings in the stationary cutting element 29, are driven via two sets of conical gears 30 and 31 by the motor shaft 32. FIG. 6*d* shows the path of point A of a tooth 33 of the drivable cutting element. The reference numeral 34 refers to a cooperating tooth of the stationary cutting element.

If hairs are being cut by a plurality of pairs of teeth at the same instant, this presents a high peak load to the motor, so that the power of this motor should be adapted thereto. This high peak load of the motor can be avoided by a construction where the distance between the cutting edges of one or more pairs of teeth differs from the distance between the cutting edges of one or more other pairs of teeth. FIG. 7 shows an example of this. The distance between cutting edge 35 and cutting edge 36 of each pair of teeth slightly increases from the centre towards the side edges (a1 . . . a5). For this purpose the recesses with the cutting edges 35 are successively situated nearer the ends 37 of the corresponding teeth. It is alternatively possible to stagger the cutting edges 36.

A special embodiment is shown in FIG. 8, which in a similar way is in FIG. 2 shows certain components in exploded view. The embodiments of FIGS. 2 and 8 are largely identical and corresponding parts bear the same reference numerals. However, the two cutting elements 4 and 5 of the embodiment of FIG. 8 are provided with additional rows of teeth 40 and 41 on the sides 38 and 39 respectively. In the assembled condition of the apparatus these rows of teeth 40 and 41 are also positioned on each other and then project from the housing. The sides 38 and 39 extend substantially transversely to the sides 42 and 43 having the teeth 6 and 7. As the cutting element is again driven in the direction P and in the opposite direction, the row of teeth 41 then moves in the longitudinal direction of this row relative to the row of teeth 40, as is the case with the known trimmers.

Thus a versatile apparatus is obtained, of which the rows of teeth 40 and 41 may be used for trimming and the rows of teeth 6 and 7 for thinning, only a single simple drive machanism being used.

Obviously, the hair trimming apparatus may also take the form of an accessory for a personal care appliance, such as a shaving apparatus or message apparatus.

What is claimed is:

1. A hair trimming device, which comprises a stationary cutting element having a longitudinally extending side provided with teeth extending in a direction substantially transverse to said side; a second cutting element drivable relative to the stationary cutting element in said transverse direction, said drivable cutting element having a longitudinally extending side provided with teeth extending in a direction substantially transverse to said latter side, each tooth of the drivable cutting element cooperating with a corresponding tooth of the stationary cutting element to form a pair, the two teeth in each pair at least partly overlapping each other, and adjacent pairs being spaced from each other; a recess formed in at least one side edge of each tooth of one of said cutting elements, at least a part of the edge of said recess constituting a cutting edge; and cutting edge on each tooth of the other cutting element, the cutting edges on the teeth of each pair cooperating with each other.

2. A hair trimming device according to claim 1, in which the recesses are formed in the teeth of the stationary cutting element.

3. A hair trimming device according to claim 2, in which the drivable cutting element is drivable only in said transverse direction and the two cooperating teeth of each pair substantially coincide.

4. A hair trimming device according to claim 3, in which the cutting edge of each tooth of the stationary cutting element extends transversely to the tooth direction, and the cutting edge of each tooth of the drivable cutting element is located at the end of the tooth and extends transversely to the tooth direction.

5. A hair trimming device according to claim 4, in which the distance between the cutting edges of the cooperating teeth of at least one pair differs from the distance between the cutting edges of the cooperating teeth of at least one other pair, measured between opposite points of the cutting edges.

6. A hair trimming device according to claim 1, in which each cutting element has a side extending substantially transversely relative to its longitudinally extending side, each such transversely extending side being provided with outwardly extending teeth, said latter teeth of the two cutting elements cooperating with each other.

* * * * *